US007231171B2

(12) United States Patent
Shibata et al.

(10) Patent No.: US 7,231,171 B2
(45) Date of Patent: Jun. 12, 2007

(54) IMAGE COPYING APPARATUS AND IMAGE COPYING METHOD

(75) Inventors: Yoshifumi Shibata, Toyokawa (JP); Tetsuya Kagawa, Aichi-ken (JP); Yuichi Kuroyanagi, Kariya (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 266 days.

(21) Appl. No.: 11/028,677

(22) Filed: Jan. 5, 2005

(65) Prior Publication Data

US 2006/0067758 A1 Mar. 30, 2006

(30) Foreign Application Priority Data

Sep. 24, 2004 (JP) ..... 2004-277873

(51) Int. Cl.
*G03G 15/00* (2006.01)

(52) U.S. Cl. ..... 399/367; 399/365; 399/405; 399/368; 399/369; 271/298; 271/3.15; 271/3.17

(58) Field of Classification Search ..... 399/365, 399/367, 405, 369; 271/298, 3.15, 3.17
See application file for complete search history.

(56) References Cited

U.S. PATENT DOCUMENTS

| | | | | |
|---|---|---|---|---|
| 4,847,656 | A * | 7/1989 | Kuno et al. | 399/84 |
| 5,096,184 | A * | 3/1992 | Maekawa et al. | 271/288 |
| 5,289,250 | A * | 2/1994 | Hiroi et al. | 399/405 |
| 5,328,169 | A * | 7/1994 | Mandel | 271/290 |
| 5,382,011 | A * | 1/1995 | Tani | 270/37 |
| 6,249,658 | B1 * | 6/2001 | Inui et al. | 399/82 |
| 6,494,453 | B1 * | 12/2002 | Yamada et al. | 271/288 |
| 6,522,862 | B2 * | 2/2003 | Koshimizu et al. | 399/405 |
| 2002/0191980 | A1 * | 12/2002 | Kudo | 399/81 |
| 2003/0086130 | A1 * | 5/2003 | Guddanti et al. | 358/498 |

FOREIGN PATENT DOCUMENTS

| | | |
|---|---|---|
| JP | 2003-029473 | 1/2003 |
| JP | 2003-122062 | 4/2003 |
| JP | 2003-323084 | 11/2003 |

OTHER PUBLICATIONS

Japanese Notification of Reasons for Refusal mailed Mar. 6, 2007, directed to related JP application no. 2004-277873, 5 pages.

* cited by examiner

*Primary Examiner*—Ren Yan
*Assistant Examiner*—Matthew Marini
(74) *Attorney, Agent, or Firm*—Morrison & Foerster LLP

(57) ABSTRACT

The image copying apparatus of the present invention comprises a document drawing-in port for drawing an original document before reading operation in and a document discharging port for discharging the original document after reading operation, and copies images of the original document on a medium. The image copying apparatus further comprises trays more than two which are movable upward and downward within a range covering a document feeding position to the document drawing-in port, a receiving position from the document discharging port, and a bottom region located further lower than the lower of these positions. At least one of the trays moves to a position within the bottom region, a tray on which an original document is placed moves to a document feeding position, and another tray moves to a document receiving position.

12 Claims, 14 Drawing Sheets

IMAGE COPYING APPARATUS AND IMAGE COPYING METHOD

This application is based on Application No. 2004-277873 filed in Japan, contents of which are hereby incorporated by reference.

BACKGROUND OF THE INVENTION

1. Field of the Invention

The present invention relates to an image copying apparatus and an image copying method for reading images on an original document and copying the images on a sheet. More specifically, the present invention relates to the image copying apparatus including an automatic document feeding device, and an image copying method in the image copying apparatus.

2. Description of the Related Art

In recent years, universal designs aiming to embody products easy for any people to use have been adopted. In this circumstance, an image copying apparatus including an automatic document feeding device is also desired to incorporate universal designs. Conventionally, in the image copying apparatus, a document reading device is located at the uppermost portion of the image copying apparatus. This is because the document reading device is also used as a reading unit for an original document in a statically placed state. For this reason, in many cases, a document inserting port of the automatic document feeding device is also located in the vicinity of the uppermost portion of the image copying apparatus. In a general large-sized image copying apparatus, the uppermost portion of the apparatus where the document inserting port is located is about 1200 mm in height. Therefore, operations of inserting original documents into the document inserting port and checking the inserted state of the originals are not easy for persons in wheelchairs and children short in height.

As an attempt to solving this problem, there has been proposed an image copying apparatus which utilizes a manual sheet feeding tray or a sheet feeding cassette as document feeding means for persons in wheelchairs (see e.g. Japanese Laid-Open Patent Publication No. 2003-122062). These are sheet feeding means conventionally located at low position. According to this apparatus, for example, a feeding path for feeding a sheet-like document from the manual sheet feeding tray to an automatic document reading device is formed. Then, the sheet-like document after reading operation is discharged to document discharging means or to the manual sheet feeding tray.

However, in the conventional image copying apparatus described above, a feeding path is additionally formed inside the apparatus. Therefore, the document feeding path has an increased length by this additional length. In general, it is more difficult to ensure the feeding reliability of an original sheet as compared with a sheet for forming images. This is because original documents are of a wide variety of sheets. For example, there are many cases where the end of the sheet is folded or where the sheet is entirely warped. There are also many cases where the friction coefficients on the original sheet surface do not distribute uniformly depending on whether ink is present or absent, and the like. If paper jam occurs in the course of the feeding path, there is a fear that an important original is damaged. For this reason, it is not much preferable that the document feeding path is long in length.

The conventional image copying apparatus described above also has a problem in discharging the original document reading operation. In order to discharge the document at a low position as is the case of inserting, the original document is discharged to the manual sheet feeding tray which is the same tray from which the original has been inserted. Thus, only one sheet of original can be processed at one time. Specifically, one sheet of original is inserted into the manual sheet feeding tray to read the image thereof. The original after the reading operation is discharged from the same manual sheet feeding tray. Then, the next original is inserted. Therefore, it cannot be that the operation efficiency is good and there is a problem that the productivity of the copying operation is low.

SUMMARY OF THE INVENTION

The present invention has been made to solve the problems residing in the conventional image copying apparatus and image copying method described above. Specifically, an objective of the present invention is to provide an image copying apparatus and image copying method capable of locating both the document inserting and discharging places at low positions without increasing the length of the document feeding path and having excellent copying operation efficiency.

To achieve the purpose of the invention, there is provided an image copying apparatus comprising: a document drawing-in port for drawing a document before reading operation in; a document discharging port located above or below the document drawing-in port for discharging the document after reading operation; a document feeding path extending from the document drawing-in port to the document discharging port; an image reading section provided in a midway of the document feeding path; a first and a second trays movable upward and downward within a range covering a document feeding position where a document is fed to the document drawing-in port, a document receiving position where a document is received from the document discharging port, and a bottom region located further lower than the lower of these positions; a first tray-controlling section for the time a document is to be placed on a tray, which moves at least one of the first and the second trays to a position within the bottom region; and a second tray-controlling section for the time a reading operation starts, which moves either one of the first and the second tray on which a document is placed to the document feeding position and moves the other tray to the document receiving position.

According to the image copying apparatus, the original document is fed from the document drawing-in port to the document discharging port. Further, the document drawing-in port is located above or below the document discharging port. It is sufficient that an image reading section is located between the document drawing-in port and the document discharging port, and the document feeding path does not have a too much long length. Further, the first and the second trays are made to be movable upward and downward within a range covering positions at the document drawing-in port and at the document discharging port. The range also covers a bottom region located at a position further lower than the lower of these positions. Therefore, these trays can face the user within the bottom region which is located at a low position. In other words, the user can place an original document at the bottom region so as to subject the document to a reading operation. At the same time, since the document can be discharged to the other tray, continuous reading is possible. As a result, the document inserting place can be located at a low position without increasing the length of the document feeding path, and an image copying apparatus having good efficiency of copying operation is achieved.

To achieve the purpose of the invention, there is provided an image copying apparatus comprising: a document drawing-in port for drawing a document before reading operation in; a document discharging port located above or below the document drawing-in port for discharging the document after reading operation; a document feeding path extending from the document drawing-in port to the document discharging port; an image reading section provided in a midway of the document feeding path; a copied-medium discharging port for discharging a copied-medium on which an image of a document is copied; a plurality of trays movable upward and downward within a range covering a document feeding position where a document is fed to the document drawing-in port, a document receiving position where a document is received from the document discharging port, a copied-medium receiving position where a copied-medium is to be received from the copied-medium discharging port, and a bottom region located further lower than the lowest one of these positions; placed substance sensors provided to each of the plurality of trays for detecting a placed substance; a first tray-controlling section for the time a document is to be placed on a tray, which moves at least one of the trays to a position within the bottom region basing on an operation by the user in case there is no tray within the bottom region; a read-document receiving tray setting section for setting one of trays other than the tray on which a document is placed as a read-document receiving tray basing on the result of detection by the placed substance sensors; a copied-medium receiving tray setting section for setting one of trays other than the read-document receiving tray as a copied-medium receiving tray; a second tray-controlling section for the time a reading operation starts, which moves the tray on which a document is placed to the document feeding position and moves the read-document receiving tray to a document receiving position; a third tray-controlling section for the time a copying operation starts, which moves the copied-medium receiving tray to a copied-medium receiving position before the copying operation is started; and a forth tray-controlling section for the time a copying operation finishes, which moves the read-document receiving tray and the copied-medium receiving tray to positions within the bottom region.

According to the image copying apparatus, there is provided a plurality of movable trays. Further, whether or not a substance is placed on each tray is checked by the placed substance sensors. Therefore, among trays on which no substance is placed, a read-document receiving and a copied-medium receiving trays are automatically selected. Therefore, the user is only required to place an original document at a low position. With this arrangement, the user can take out the read-document and the copied-medium at low positions.

To achieve the purpose of the invention, there is provided an image copying method in an image copying apparatus including a plurality of movable trays for copying images of original onto a medium, comprising the steps of: moving a first tray on which an original document is placed from a position where the original document was placed to a document feeding position where the original document is drawn into the image copying apparatus; moving one of trays other than the first tray to the document receiving position; drawing in and feeding the original document placed on the first tray within the image copying apparatus, and discharging the original document to a second tray located at a document receiving position; and reading an image of the original document while feeding the original document.

BRIEF DESCRIPTION OF THE DRAWINGS

For a better understanding of the present invention, reference is made to the following detailed description of the invention, just in conjunction with the accompanying drawings in which.

DETAILED DESCRIPTION OF THE PREFERRED EMBODIMENTS

A preferred embodiment of the invention is described specifically below while referring to the accompanying drawings. This embodiment is an application of the invention in an image copying apparatus including an automatic document feeding device and an automatic document reading device.

[First Embodiment]

Figure 1:
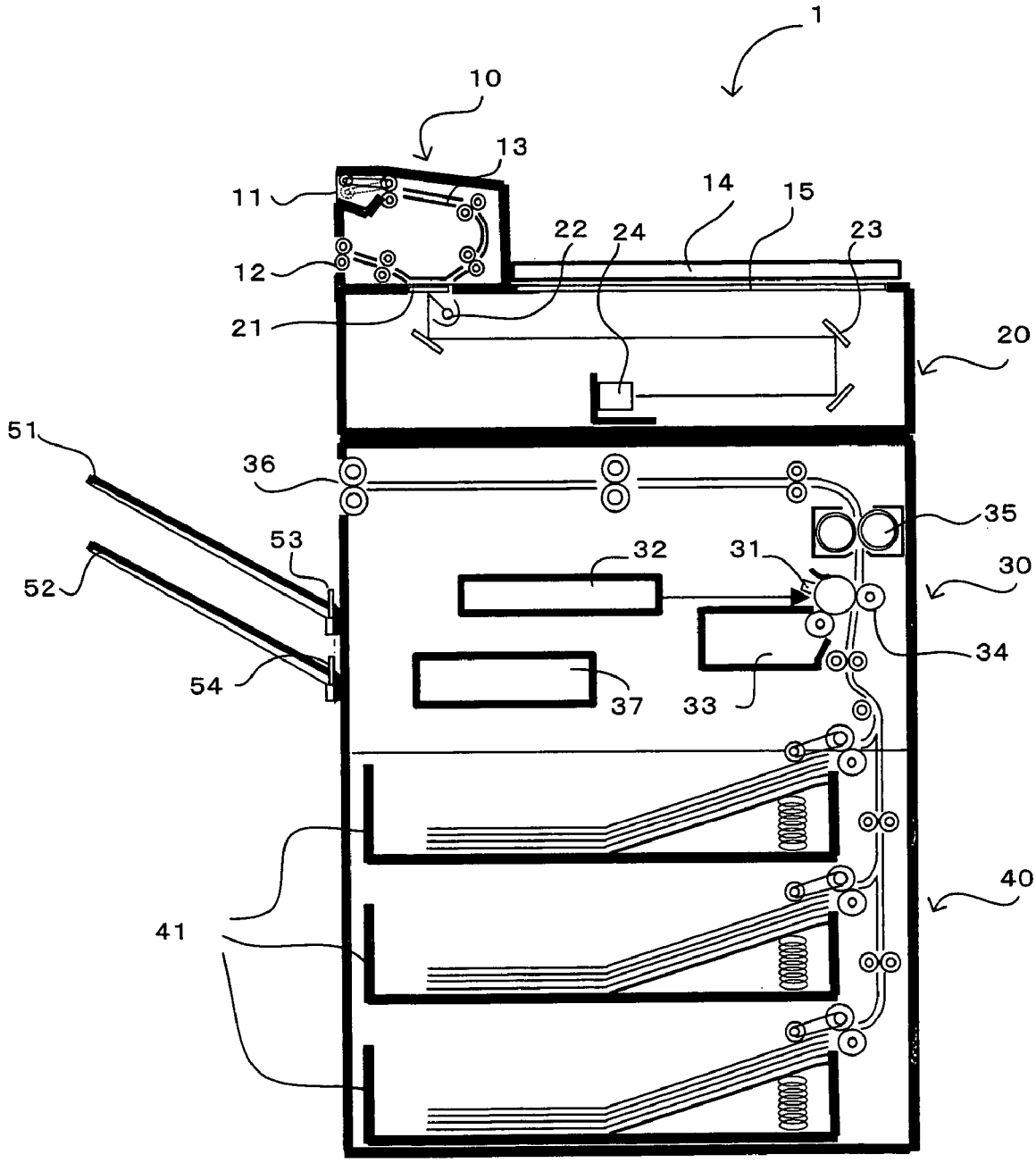
FIG. 1 is a schematic structural diagram of an image copying apparatus of First Embodiment.

An image copying apparatus 1 of this embodiment comprises, as is schematically shown in FIG. 1, a document feeding section 10, a document reading section 20, an image forming section 30, and a sheet supplying section 40 in this order from above. The document feeding section 10 feeds original documents one by one from a drawing-in port 11 located at an upper side in FIG. 1 to a discharging port 12 located below the drawing-in port 11 through a document feeding path 13. The document feeding path 13 is folded in the midway into the shape of "U" letter, and faces a reading position 21 of the document reading section 20 at the downstream of the folded portion. Due to this form, the reading operation is performed while the original document being fed, that is, reading while being fed is performed. The image copying apparatus 1 further comprises a document cover 14 and a document glass 15, and is capable of reading operation for an original placed in a flat posture on the document glass 15. Here, the drawing-in port 11 corresponds to a document drawing-in port, and the discharging port 12 corresponds to a document discharging port.

The document reading section 20 comprises an illumination device 22, a plurality of mirrors 23, and an image sensor 24. With this arrangement, the document reading section 20 reads an image on the document passing through the reading position 21 so as to acquire the read image as image data. The image forming section 30 forms an image onto a sheet basing on the image data acquired in the document reading section 20. Here, as the image forming section 30, exemplified is an image forming section including a charging unit 31, an exposure unit 32, a development unit 33, a transfer unit 34, and a fixing unit 35 and performs image formation in an electronic photographing method. The sheet on which the image has been formed is discharged outside the image copying apparatus 1 through the sheet discharging port 36. The image forming section 30 also comprises a controller 37 for controlling the entire operations of the image copying apparatus 1. The sheet supplying section 40 comprises a sheet cassette 41 capable of accommodating various kinds of sheets, and selectively supplies sheets in synchronization with the image forming operation of the image forming section 30. Here, the sheet discharging port 36 corresponds to a copied-medium discharging port.

In the image copying apparatus 1, as shown in FIG. 1, the drawing-in port 11 and discharging port 12 of the document feeding section 10, and the sheet discharging port 36 of the image forming section 30 are located on the same side surface. Outside of the side surface, two movable trays 51, 52 are located. These movable trays 51, 52 are arranged to be movable upward and downward along the outside surface of the image copying apparatus 1. As an arrangement for the movement of each tray, the same arrangement as that conventionally used for finisher can be utilized. The movable trays 51, 52 are located in such a manner that they are inclined downward toward the side surface of the image copying apparatus 1. Due to this arrangement, located substances such as paper are moved to a lower right direction in FIG. 1 by gravity.

Here, the movable range of the movable tray 51 located at the upper side covers at least the following range. At the most lifted position, the illustrated right end portion of the movable tray 51 is located at the position opposing to the drawing-in port 11 of the sheet feeding section 10. At the most descended position, the illustrated right end portion of the movable tray 51 is located either one of the lower one between the position opposing to the sheet discharging port 36 of the image forming section 30 or the position at a height of about 50 cm from the floor surface. The movable range of the movable tray 52 located at the lower side covers at least the range from the position where the illustrated right end portion of the movable tray 52 is opposed to the discharging port 12 of the document feeding section 10 to the position slightly lower than the position of the bottom end of the movable tray 51.

Figure 2:
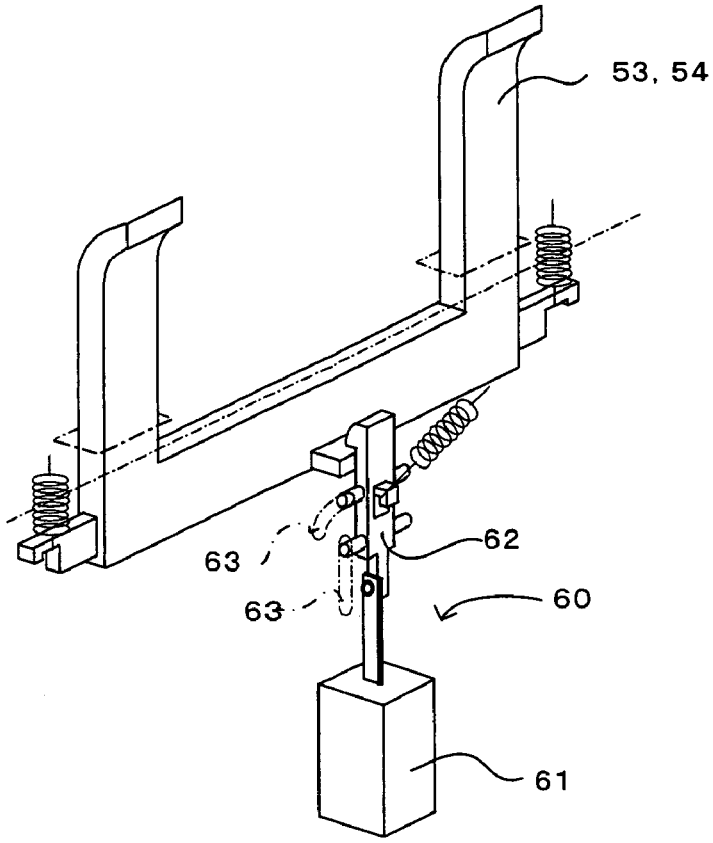
FIG. 2 is an illustrative diagram showing a stopper.

The movable trays 51, 52 are respectively provided with stoppers 53, 54. The stoppers 53, 54 are, as shown in FIG. 2, respectively comprises a base portion located substantially horizontally and fence portions projecting upward in FIG. 2 form both end portions of the base portion. The base portion is forced upward in FIG. 2 by a spring and the like. Due to this arrangement, in a natural state, as shown in FIG. 1, the fence portions of the stoppers 53, 54 are in a state where they project upward above the upper surface of the movable trays 51, 52. Therefore, in this state, the sheet mounted on the movable trays 51, 52 are stopped when it is in contact with the stoppers 53, 54. As a result, the sheet is held on the upper surface of the tray.

On the other hand, a stopper retracting section 60 is provided in the vicinity of the drawing-in port 11 of the document feeding section 10. The stopper retracting section 60 comprises, as shown in FIG. 2, a solenoid 61 and a lever 62. Further, a projecting portion of the lever 62 is engaged with a groove 63 which is formed in the image copying apparatus 1. When one of the movable trays 51, 52 is located at the drawing-in port 11, the stopper 53 or 54 will be retracted by the stopper retracting section 60.

Specifically, in this case, the lever 62 is pulled down by the solenoid 61. As a result, the projecting portion of the lever 62 is induced by the groove 63. Accordingly, the top end portion of the lever 62 is inclined toward the depth direction in FIG. 2. Further, the top end portion of the lever 62 is engaged with the base portions of the stopper 53 or 54. As a result, the stopper 53 or 54 is pulled down in FIG. 2. Thus, a state where a sheet can be drawn in is established. The stopper retracting section 60 corresponds to a retracting member.

Figure 3:
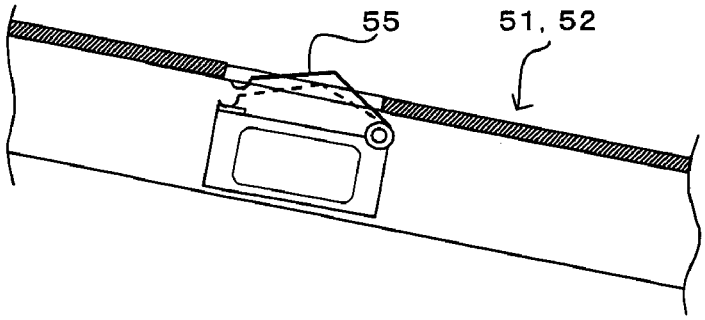
FIG. 3 is an illustrative diagram showing a sheet sensor.

Further, a sheet sensor 55 is provided on the upper surface of the movable trays 51, 52, respectively. The sheet sensor 55 may be a pawl mechanism such as shown in FIG. 3, for example. When a sheet is placed on the tray, the pawl is pushed down. The placement of the sheet is detectable by a detecting unit located below the pawl. The sheet sensor 55 responds even to one sheet. Alternative to the pawl mechanism, the sheet sensor 55 may be constituted by an optical sensor, an electric shielding sensor, or a sensor utilizing a change in electrostatic capacity or resistance value. The sheet sensor 55 corresponds to a placed substance sensor. Instead of providing the sheet sensor 55 to the movable trays 51 and 52, a push button and the like may be provided and the user pushes the button to indicate that he/she has placed the original.

Figure 4:
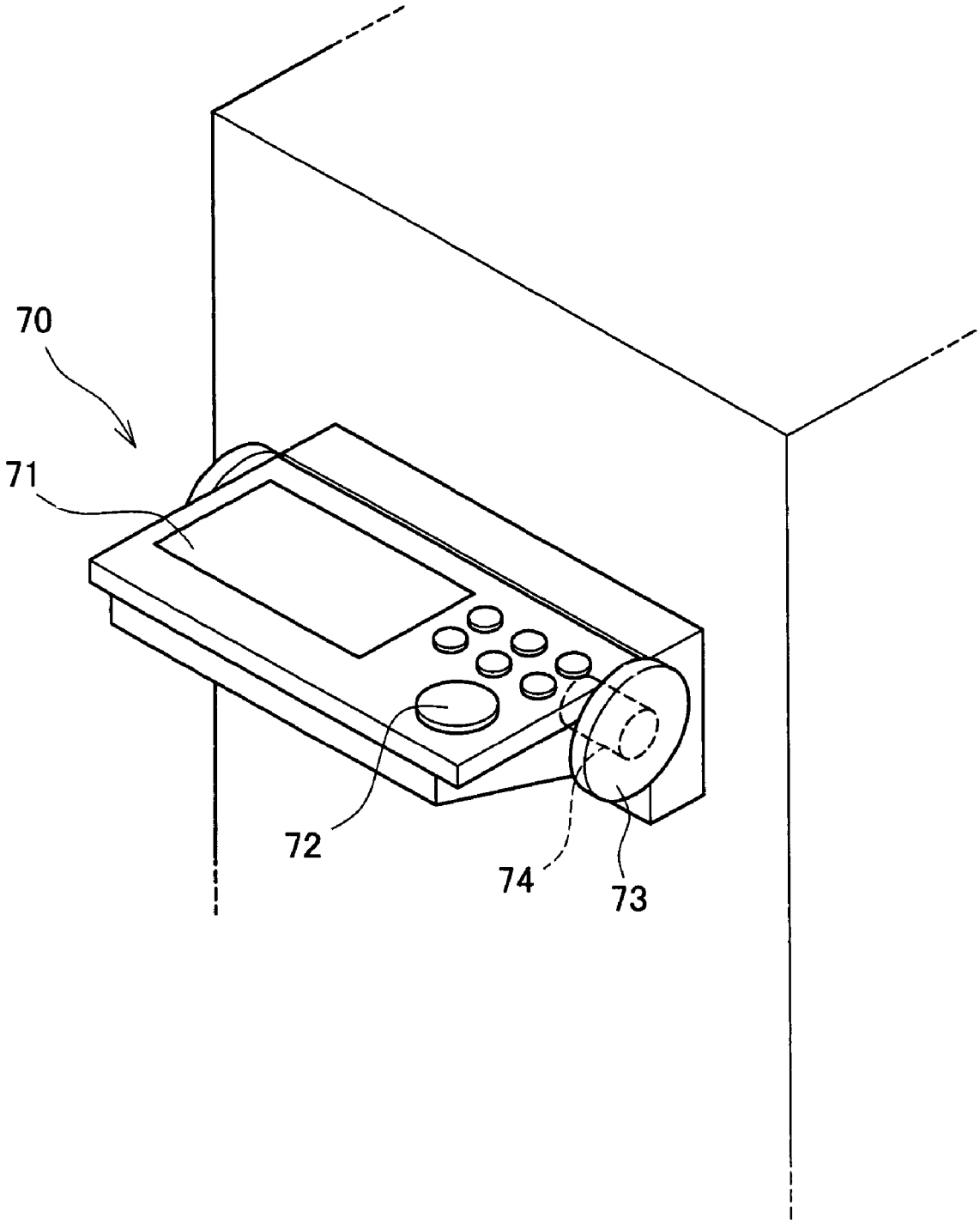
FIG. 4 is an illustrative diagram showing an operation panel.

Further, in the image copying apparatus 1 of this embodiment, as is shown in FIG. 4, an operation panel 70 is provided at a relatively low position in order that the panel 70 is easy to see for even persons in wheelchairs. The operation panel 70 comprises a touch panel 71, a button 72, and an inclination change knob 73. Further, the inclination change knob 73 of the operation panel 70 incorporates an angle detector 74 made of a variable resistor and the like. The user can change the inclination of the operation panel 70 by turning the inclination change knob 73. The inclination of the operation panel 70 at that time is detected by the angle detector 74.

Figure 5:
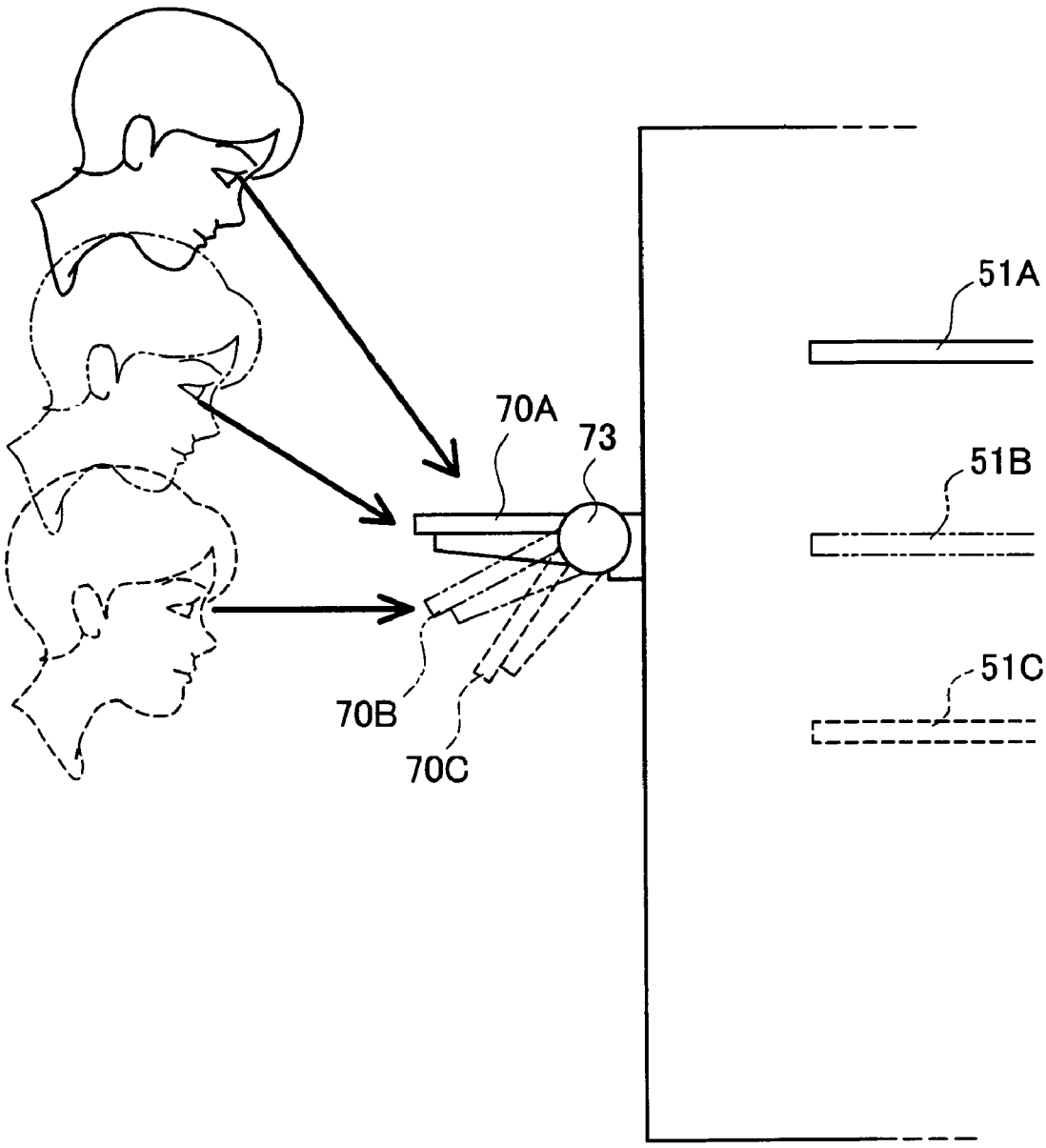
FIG. 5 is an illustrative diagram showing how to use an operation panel.

As shown in FIG. 5, the viewpoint position of the user can be estimated from the angle detected by the angle detector 74. For the user having high viewpoint position, the operation panel 70 is easy to see when the operation panel 70 is set to be close to horizontal posture (70A). On the other hand, for the user having low viewpoint position, the operation panel 70 is easy to see when the operation panel 70 is relatively sharply inclined (70C). Therefore, in the image copying apparatus 1, the height positions of the movable trays 51, 52 are changed in accordance with the set angle of the operation panel 70.

For example, in an example shown in FIG. 5, when the operation panel 70 is located at an inclination 70A, the movable tray 51 is located at the height 51A. The height 51A is a height easy to see from the viewpoint position estimated from the inclination 70A. When the operation panel 70 is located at inclinations 70B, 70C, respectively, the movable tray 51 is located to the heights 51B, 51C, respectively. Therefore, the user is only required to adjust the inclination of the operation panel 70 to an inclination easy to see by turning the inclination change knob 73. As a result of this operation, the movable tray 51 is automatically located to a height position easy to check the placement state of the original. The movable tray 52 may be located slightly below the movable tray 51.

Alternatively, a button or the like for directly instructing the upward and downward movements of the movable trays 51, 52 may be provided in the vicinity of the operation panel 70 or of the movable trays 51, 52. In this structure, the user can move the movable trays 51, 52 directly to his desiring height positions. When the height positions of the movable trays 51, 52 are instructed by pushing this button, thus-instructed locations take precedence.

Next, a copying operation of the image copying apparatus 1 will be briefly described. Here, there are only two movable trays 51, 52, and it is structurally impossible to exchange the upper/lower relation between them. Further, in the image copying apparatus 1, the discharging port 12 is located at a position lower than the drawing-in port 11. Due to this structure, when the original document is subjected to a reading operation, the original is fed from the upper movable tray 51 to the lower movable tray 52. The user moves the movable tray 51 to his/her desiring height and sets an original document, and then, pushes the button on the operation panel 70 to issue a command to start the copying operation.

In response to the pushing of the button, in the image copying apparatus 1, the movable tray 51 is moved to the drawing-in port 11 of the document feeding section 10. Further, the movable tray 52 is moved to the discharging port 12. At these locations, the original document placed on the movable tray 51 is read and then is discharged to the movable tray 52. This reading operation is executed utilizing the document feeding section 10 which is an automatic document feeding device. Therefore, continuous reading operations are possible, and operation efficiency is good. The original after the reading operation is placed on the movable tray 52.

When reading operation is completed for all sheets of the original document, the movable tray 51 is empty. After that, the movable tray 51 is moved to the sheet discharging port 36 of the image forming section 30. Then, sheets on which the copied images are formed by the image forming section 30 are discharged to the movable tray 51. As a result, sheets after copying processing are placed on the movable tray 51. When the copying operation is completely finished, the movable trays 51, 52 are returned to their original positions where they are located when the command to start the copying operation was issued. Therefore, the user can place the originals, can pick up them, and pick up the sheets after copying operation all at low positions.

Figure 6:
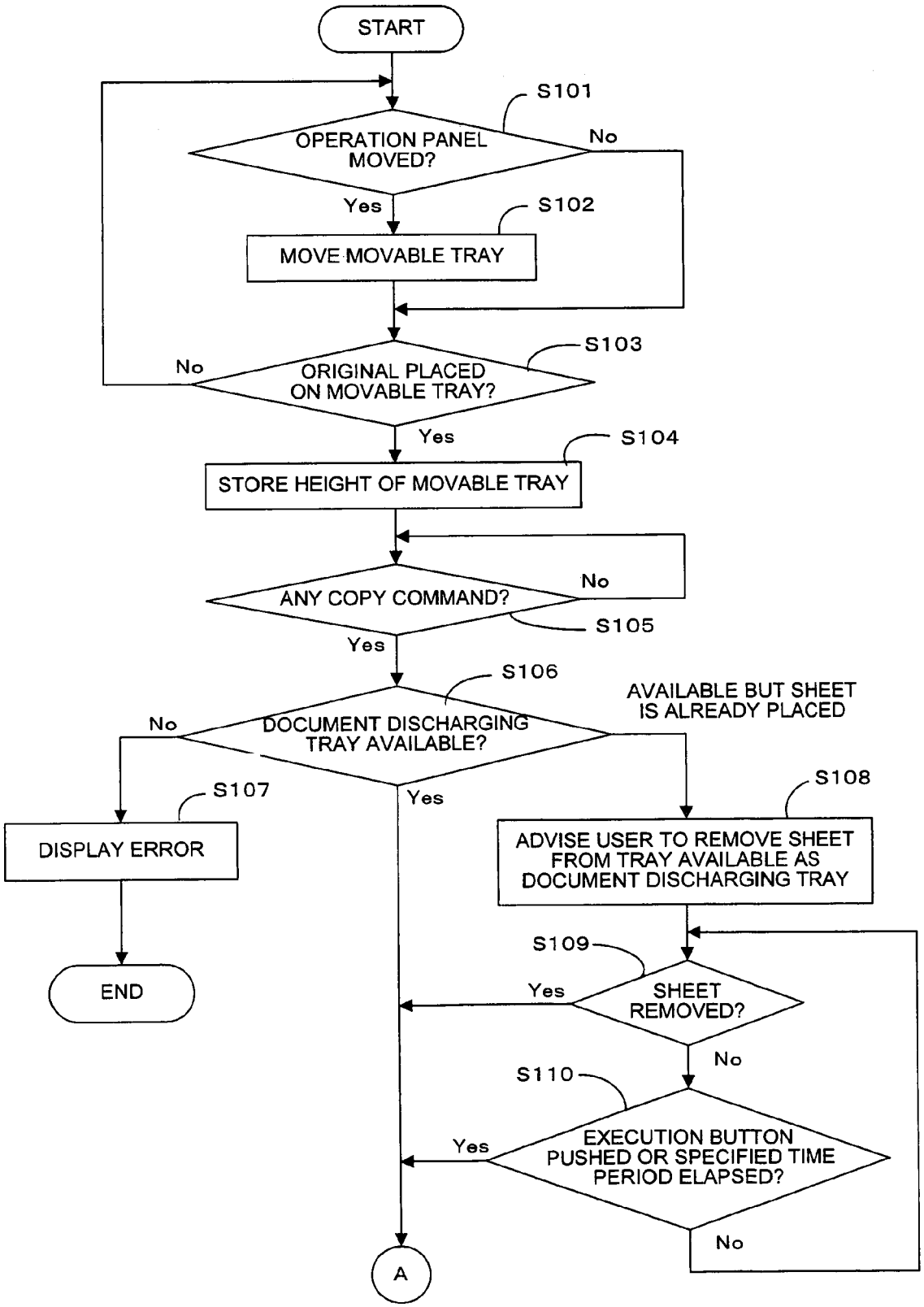
FIG. 6 is a flowchart showing copying operation of an image copying apparatus.
Figure 7:
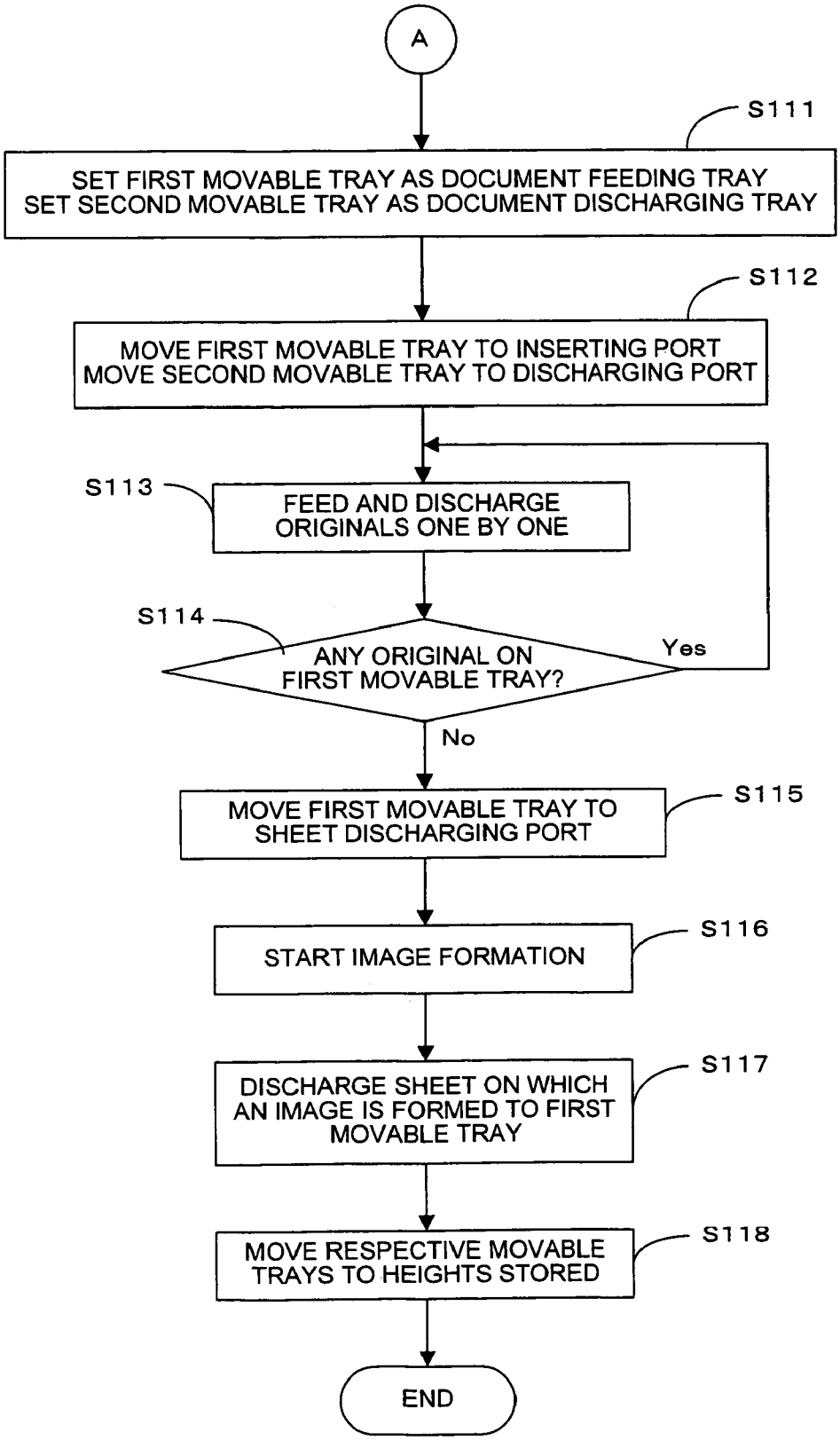
FIG. 7 is a flowchart showing copying operation of an image copying apparatus.

A copying processing according to the image copying apparatus 1 will be described by way of flowcharts of FIGS. 6 and 7. This processing is executed by the controller 37. When this processing is started, first of all, it is determined whether or not the inclination of the operation panel 70 has been changed by the user (S101) If changed (S101: Yes), the height positions of the movable trays 51, 52 are changed in accordance with the inclination of the operation panel 70 (S102). Alternatively, if the tray moving button has been pushed, the height positions of the movable trays 51, 52 are changed in response to the command made through the button.

At this time, the movable range of the movable trays 51, 52 comprises a low position at a height of about 50 cm from the floor level. Therefore, even a user having a low viewpoint such as a person in wheelchair for example can see the state of original document placed on the tray. At this time, the controller 37 serves as a bottom position designating section and a first tray-controlling section for the time a document is to be placed on a tray.

Next, it is determined by the sheet sensor 55 whether or not an original has been placed on the movable tray 51 or 52 (S103). If it is determined that an original has been placed on the movable tray 51 or 52 (S103: Yes), the height of the movable tray 51 or 52 of this time is stored (S104). At this time, the controller 37 serves as a tray position storing section. Then, an input of copy command from the operation panel 70 and the like is waited (S105).

When a copy command is issued (S105: Yes), the movable tray on which the original is placed at this moment is used as a document feeding tray. In correspondence with this arrangement, it is determined whether or not there is a tray available as a document discharging tray (S106). When an original has been placed on the movable tray 51, the movable tray 52 is available as a document discharging tray. Contrarily, when an original has been placed on the movable tray 52, it is impossible to use the movable tray 51 as a document discharging tray. In other words, if an original has been placed on the movable tray 52, there is no tray available as a document discharging tray (S106: No). In this case, an error message is displayed on the operation panel 70 (S107). For example, a display such as "place the original on the upper tray" is produced and it is waited until the user resets the original onto the upper tray. Then, this processing is finished once and is restarted from the beginning.

Alternatively, if an original is placed on the movable tray 51 and the movable tray 52 is empty, the movable tray 52 can be set as a document discharging tray as it is (S106: Yes). Therefore, in this case, the process directly proceeds to (A) of FIG. 7. Alternatively, if there is already a sheet placed on the tray available as a document discharging tray (in this description, the movable tray 52) (S106: available but a sheet is already placed), a display for advising the user to remove the sheet from the movable tray 52 is produced (S108). When the sheet is removed from the movable tray 52 (S109: Yes), the process proceeds to (A) of FIG. 7.

Alternatively, if the execution button is pushed in a state where the sheet on the movable tray 52 is not removed or a specified time period has elapsed without any response (S110: Yes), the original of this time is discharged onto the already placed sheet. If possible, it is preferable to shift the already placed sheet slightly in a lateral direction or to turn the original by 90 degrees to exchange the length and width sides thereof with each other. In this manner, the border between the original and the already placed sheet becomes clear. In this case as well, the process proceeds to (A) of FIG. 7.

Subsequently, the processing will be described basing on the flowchart of FIG. 7. As a result of each processing described above, the movable tray 51 is set as a document feeding tray and the movable tray 52 is set as a document discharging tray (S111). Then, the movable tray 51 is moved to the drawing-in port 11 whereas the movable tray 52 is moved to the discharging port 12 (S112). At this time, the controller 37 serves as a second tray-controlling section for the time a reading operation starts. Further, the stopper retracting section 60 of the inserting port 11 is driven to push down the stopper 53 of the movable tray 51. As a result of this operation, the top portion of the original placed on the movable tray 51 enters the drawing-in port 11 by its own weight.

Figure 8:
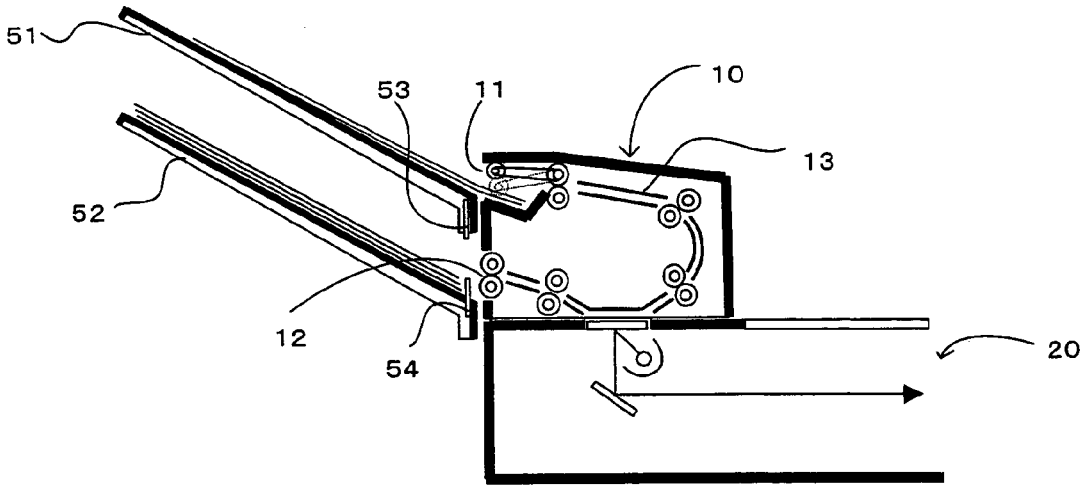
FIG. 8 is an illustrative diagram showing operation of an image copying apparatus.

Then, as shown in FIG. 8, the original sheets are fed one by one from the movable tray 51 by the document feeding section 10, and read by the document reading section 20, and discharged to the movable tray 52 (S113). Further, it is determined whether or not there are still originals on the movable tray 51 (S111). If there are still originals (S114: Yes), the reading operation is continued (S113). The reading operation is continued until there is no original any more.

After the reading operation is completed for all the original sheets placed on the movable tray 51 (S114: No), the movable tray 51 becomes empty. Contrarily, a state where all the originals are placed on the movable tray 52 is established. Then, the stopper retracting section 60 is released to bring the stopper 53 of the movable tray 51 into a lifted state. Then, the movable tray 51 is moved to the sheet discharging port 36 of the image forming section 30 (S115). At this time, the controller 37 serves as a third tray-controlling section for the time a copying operation starts. The movable tray 52 is also moved.

Figure 9:
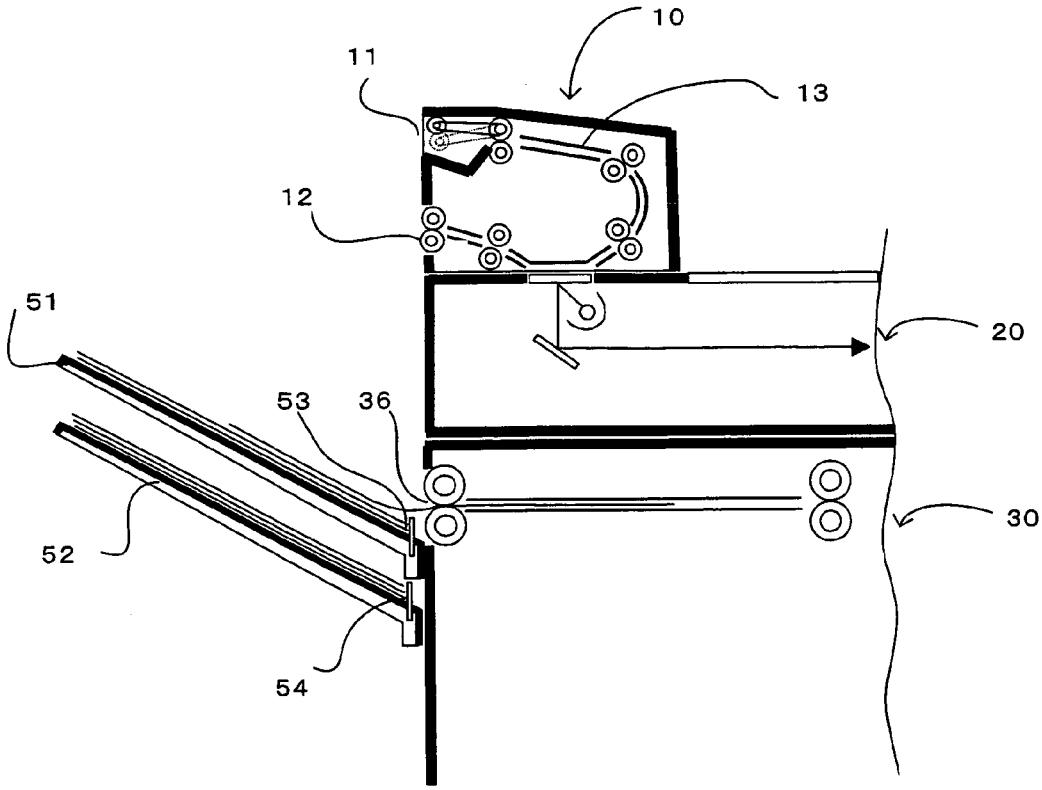
FIG. 9 is an illustrative diagram showing operation of an image copying apparatus.

Next, an image formation is started in the image forming section 30 basing on the image data read by the image reading section 20 (S116). The sheet on which an image is formed is discharged through the sheet discharging port 36, and as shown in FIG. 9, is placed onto the movable tray 51 (S117). At this time, since the stopper 53 of the movable tray 51 is in a lifted state, the discharged sheet is held on the movable tray 51. After all the images are formed, the respective movable trays 51, 52 are moved to the heights stored in Step S104 (S118). At this time, the controller 37 serves as a forth and a fifth tray-controlling section for the time a copying operation finishes and for the time a reading operation finishes. Then, the copying processing is finished.

As described above, the image copying apparatus 1 of this embodiment comprises two movable trays 51, 52. Therefore, these trays may be used also as a document feeding tray, a document discharging tray, or a sheet discharging tray for a sheet carrying the formed image. In other words, the movable tray 51 can be moved to a low position and the placement of originals can be performed at the low position. Due to this arrangement, the placement of originals is easily performed even by a person in wheelchair and the like. Further, the movable trays 51, 52 on which the discharged originals and on which the sheets carrying the formed images are placed can be moved to low positions. As a result, even a person in wheelchair and the like can easily take out the sheets. Further, the reading operation is performed continuously by use of the document feeding section 10. Therefore, the efficiency of copying operation is good. Further, the document feeding path exists only inside the document feeding section 10 and its length is short. Therefore, there is no fear of damaging the originals by paper jam and the like. In addition, since the inclination of the operation panel 70 is changeable, the operation at a low position is facilitated. Due to these arrangements, it is possible to locate both the document putting and picking-up places at low positions without increasing the length of the document feeding path, and the image copying apparatus with good efficiency of copying operation is achieved.

[Second Embodiment]

Next, a second embodiment embodying the present invention will be described in detail with reference the accompanied drawings. This embodiment describes an image copying apparatus including three or more of the movable trays of the first embodiment. The constituent elements identical to those of the first embodiments are denoted by the same reference numerals, and their description will be omitted.

Figure 10:
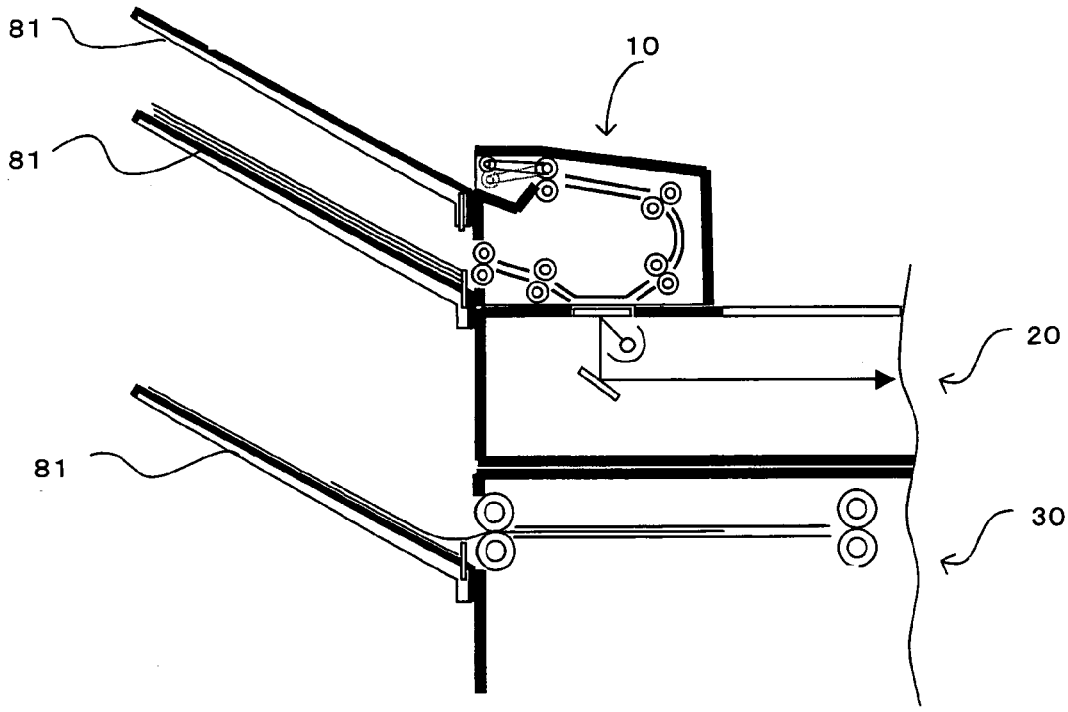
FIG. 10 is an illustrative diagram showing operation of an image copying apparatus of Second Embodiment.

An image copying apparatus 2 of this embodiment comprises a larger number of movable trays than the image copying apparatus 1 of the first embodiment. For example, as shown in FIG. 10, the image copying apparatus 2 of this embodiment comprises three movable trays 81, 81, 81. Each movable tray 81 is in the same structure as of the movable trays 51, 52 of the first embodiment. Due to this structure, as shown in FIG. 10, reading and discharging the original documents can be performed by use of two movable trays 81, 81. During executing these operations, sheets carrying the formed images can be discharged by use of the remaining movable tray 81. Therefore, the operation efficiency can be further enhanced.

Figure 11:
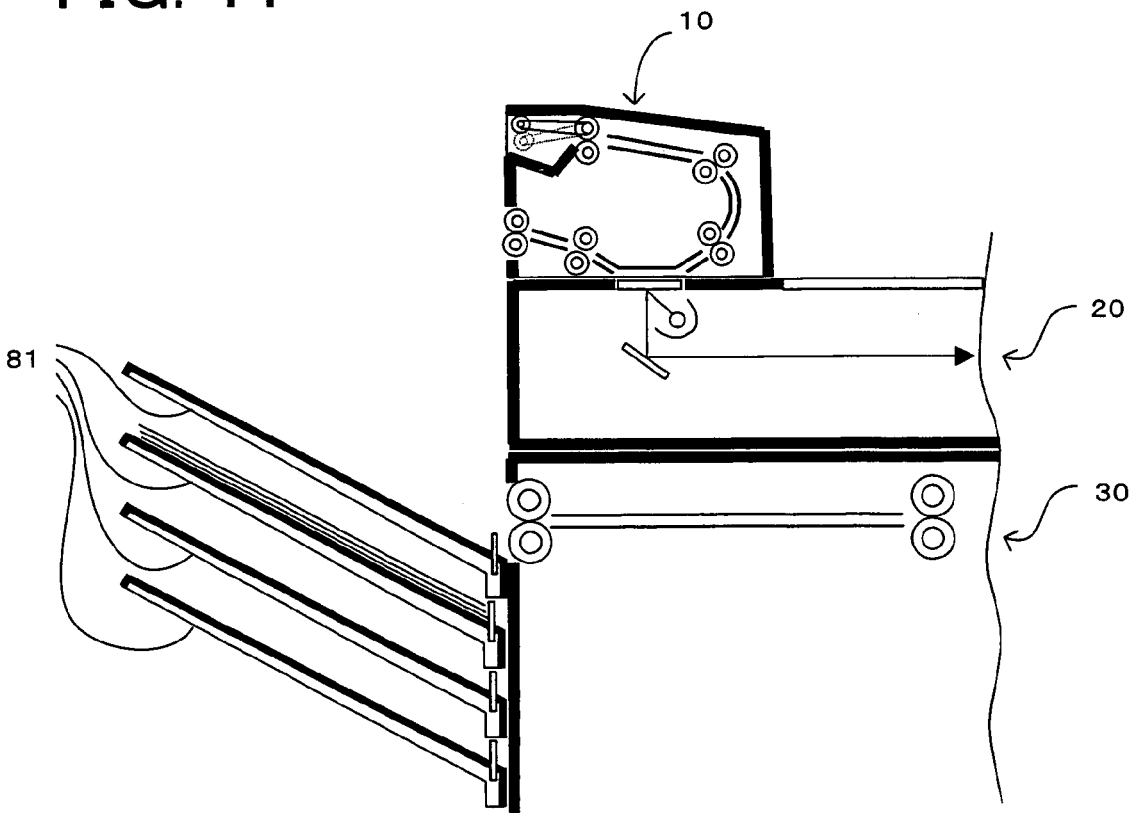
FIG. 11 is an illustrative diagram showing operation of an image copying apparatus of Second Embodiment.

Further, for example as shown in FIG. 11, the image copying apparatus of this embodiment may comprise four or more movable trays 81, 81 . . . . If further more movable trays 81 are provided, one of the trays other than the tray located at the uppermost position can be used as a movable tray 81 on which the originals are to be placed. Therefore, further variety of usage is possible. Each of these movable trays 81 is provided with a sheet sensor 55 as is the case of the movable trays 51, 52 of the first embodiment.

In this case, it is necessary to determine whether the newly placed sheet is an original or a sheet carrying formed images. First, the sheet placed on the movable tray 81 which is not located to the sheet discharging port 36 is determined as an original. The sheet placed during the time other than the image formation is also determined as an original. Contrarily, the sheet placed when a specified time period has elapsed since the image forming is started is determined as a sheet carrying formed images.

Further, it is necessary for some of the movable trays 81 to be movable up to the positions above the drawing-in port 11. To satisfy this, rails or the like are employed to extend upward beyond the document feeding section 10. Then, the movable tray 81 determined as a tray onto which an original has been placed is moved to a position opposing to the drawing-in port 11. Further, movable trays 81 determined as being empty from the detection result of the sheet sensor 55 are located to the discharging port 12 and to the sheet discharging port 36. At this time, the controller 37 serves as a read-document receiving tray setting section and a copied-medium receiving tray setting section. If there are unused movable trays 81, the movable trays 81 may be allowed to serve as sorter bins of finisher.

As described above, according to the image copying apparatus 2 of this embodiment, as is the case of the image copying apparatus 1 of the first embodiment, it is possible to locate both the document putting and picking-up places at low positions without increasing the length of the document feeding path, and the image copying apparatus with good efficiency of copying operation is achieved. Since a plurality of movable trays 81, 81 . . . is provided, the operation efficiency is further enhanced.

[Third Embodiment]

Next, a third embodiment embodying the present invention will be described in detail with reference to the accompanied drawings. This embodiment describes an image copying apparatus having a fixed tray besides the movable trays of the first embodiment. The constituent elements identical to those of the first embodiments are denoted by the same reference numerals, and their description will be omitted.

Figure 12:
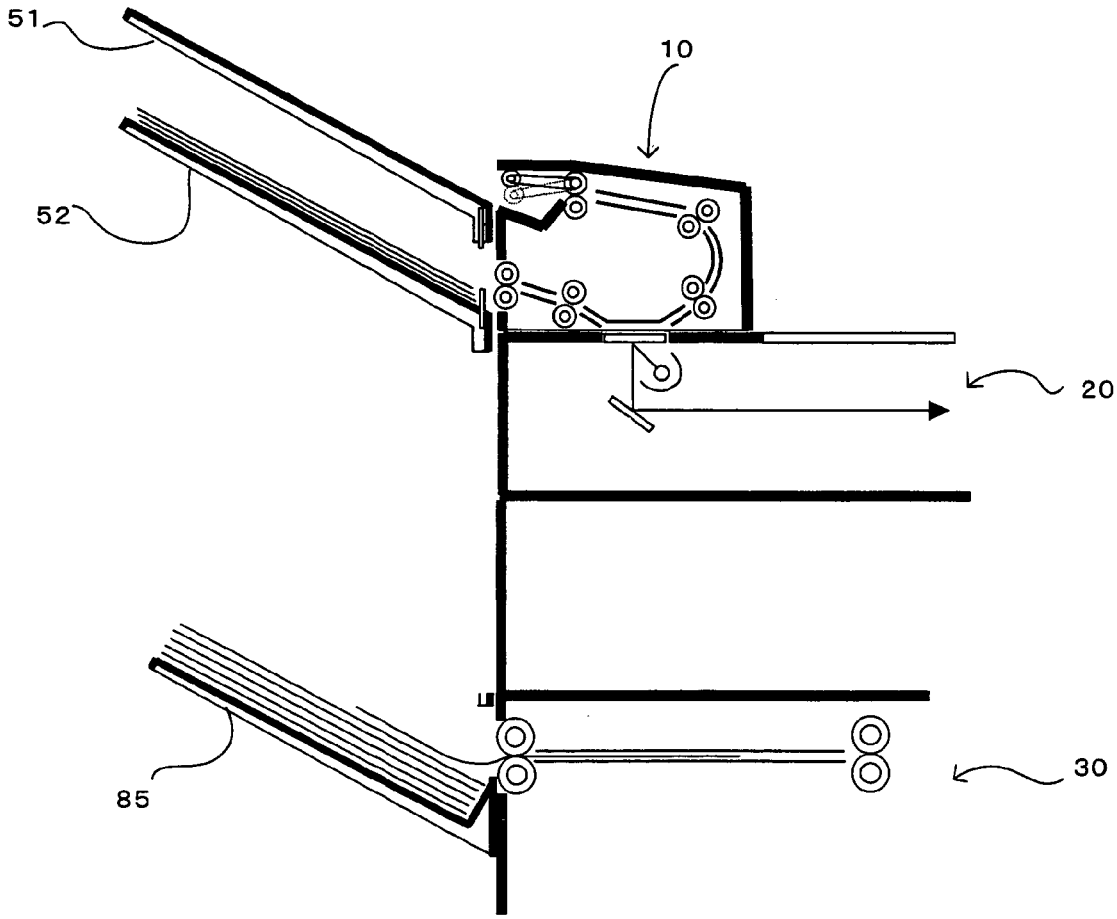
FIG. 12 is an illustrative diagram showing operation of an image copying apparatus of Third Embodiment.
Figure 13:
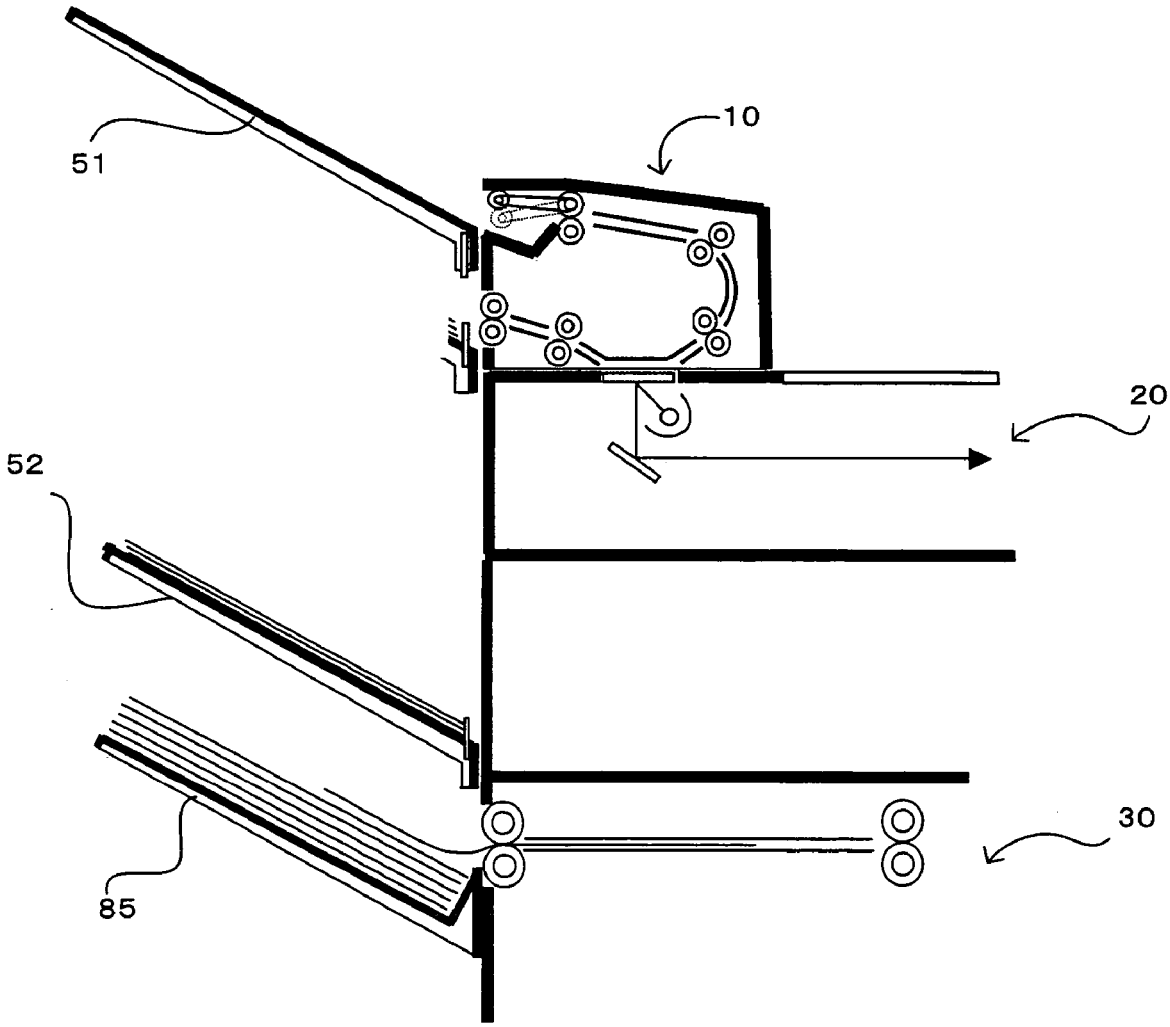
FIG. 13 is an illustrative diagram showing operation of an image copying apparatus of Third Embodiment.

An image copying apparatus 3 of this embodiment comprises, as shown in FIGS. 12 and 13, one fixed tray 85 adding to the trays of the image copying apparatus 1 of the first embodiment. The fixed tray 85 is fixed at a relatively low position at a height of about 30 to 50 cm from the floor level. The fixed tray 85 is used for placing sheets carrying formed images. Therefore, the fixed tray 85 is located next to the sheet discharging port 36.

Since there is no need to move the fixed tray 85, the fixed tray 85 may be relatively heavy in weight. Therefore, it is possible to impart higher strength to the fixed tray 85 than the movable trays 51, 52. In addition, the fixed tray 85 may have a large depth. Since the image copying apparatus 3 comprises the fixed tray 85, it is suitable for the case where a large number of sheets are output. The movable trays 51, 52 are moved upward and downward within the range down to a relatively higher position than the fixed tray 85. Therefore, as is the case of the image copying apparatus 1 of the first embodiment, it is possible to place an original on the movable tray 51 at a low position. Further, it is possible to return the original from the movable tray 52 at a low position.

As described above, according to the image copying apparatus 3 of this embodiment, as is the case of the image copying apparatus 1 of the first embodiment, it is possible to locate both the document putting and picking-up places at low positions without increasing the length of the document feeding path, and the image copying apparatus with good efficiency of copying operation is achieved. In addition, since a plurality of movable trays 51, 52 and one fixed tray 85 are provided, the image copying apparatus 3 is suitable for outputting a large number of sheets.

[Fourth Embodiment]

Next, a fourth embodiment embodying the present invention will be described in detail with reference to the accompanied drawings. This embodiment described an image copying apparatus including an operation panel with a small modification added to the structure of the first embodiment. The constituent elements identical to those of the first embodiments are denoted by the same reference numerals, and their description will be omitted.

Figure 14:
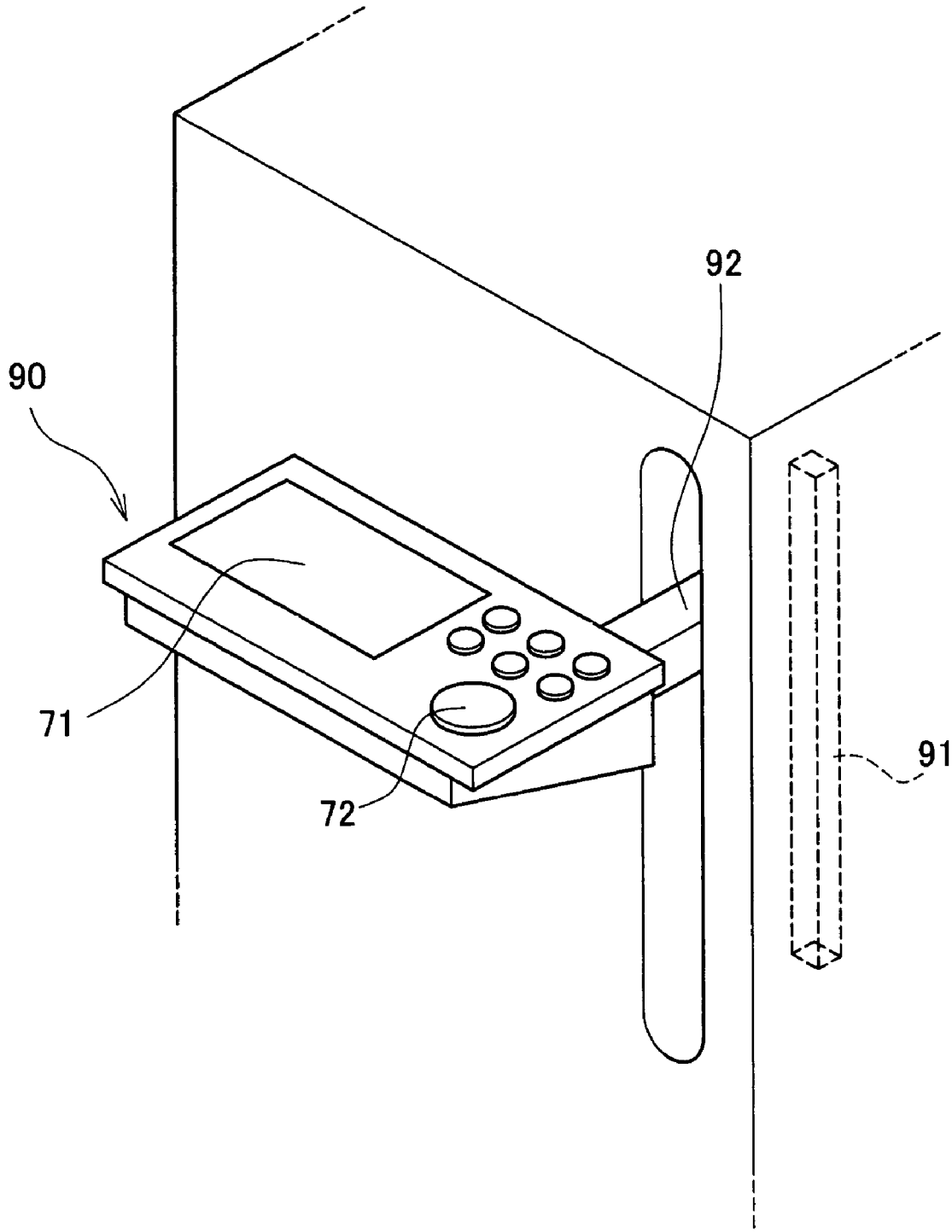
FIG. 14 is an illustrative diagram showing an operation panel.

An image copying apparatus of this embodiment comprises, as shown in FIG. 14, an operation panel 90 movable upward and downward. In this image copying apparatus, the operation panel 90 is held to be substantially horizontal by an arm 92, and is made to be movable upward and downward along a guide rail etc. provided inside the apparatus. Further, the operation panel 90 comprises a height detector 91 made of a variable resistor and the like. Therefore, the height position of the operation panel 90 at that time can be detected.

Figure 15:
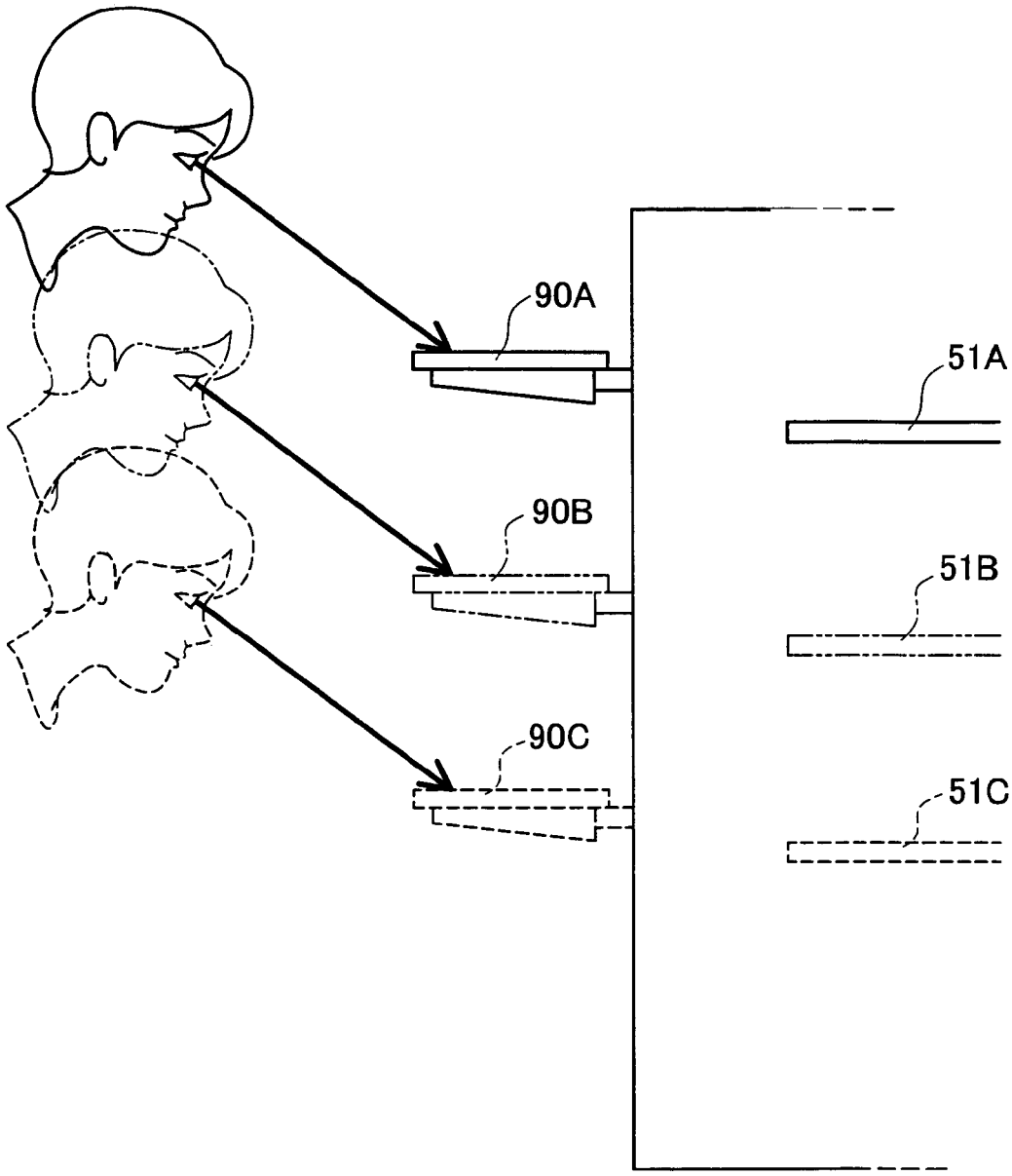
FIG. 15 is an illustrative diagram showing how to use an operation panel.

According to this image copying apparatus, the user can grip the operation panel 90 and moves it upward or downward to his desiring position. At this time, in correspondence with the movement of the operation panel 90, as shown in FIG. 15, the movable tray 51 is automatically moved. For example, the movable tray 51 is moved downward in a specified distance from the position of the operation panel 90. As a result, the movable tray 51 is located at a position easy for the user to place originals.

Figure 16:
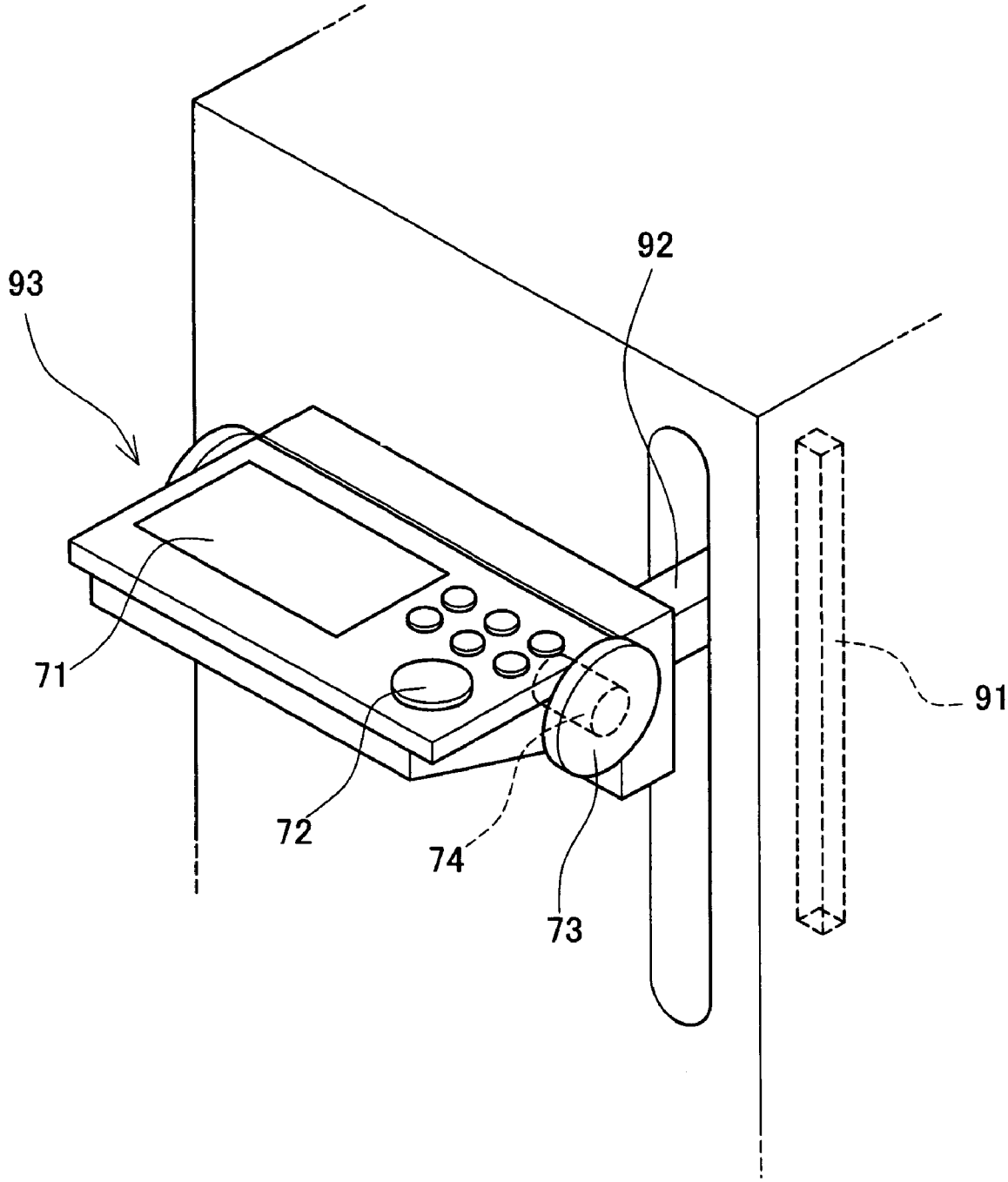
FIG. 16 is an illustrative diagram showing an operation panel.

Alternatively, as shown in FIG. 16, it is possible to employ an operation panel 93 which is movable upward and downward and also of which inclination is changeable. In this structure, the user can see the display section of the operation panel 93 at a position and angle further easier for him/her to see.

Figure 17:
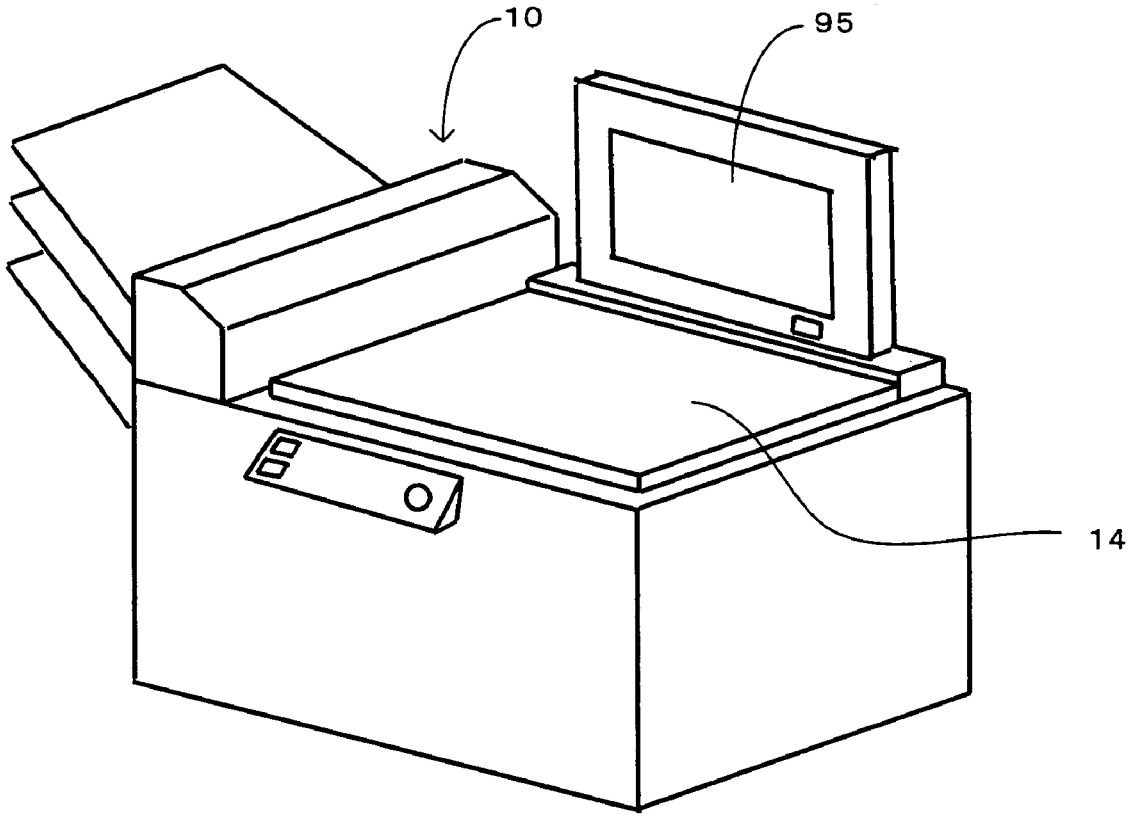
FIG. 17 is an illustrative diagram showing an image copying apparatus.

In the image copying apparatuses in the respective embodiment, the document feeding section 10 and the document cover 14 are independent units from each other. In other words, the document feeding path 13 and the like are not located on the document cover 14. Therefore, for example, as shown in FIG. 17, a display panel 95 with a large screen may be provided in adjacent to the document cover 14 at the far side along its depth. This is because there is no portion projecting at the far side toward the depth of the document cover 14 even when the document cover 14 is lifted up.

On this display panel 95, the display can be made in large letters. Alternatively, the display can be made in graphics and the like. In this case, as shown in FIG. 17, it is preferable to set the display panel 95 at an angle close to the vertical. In this manner, the display panel 95 is easy to see even for a person who operates the apparatus at a low position such as a person in wheelchair. Alternatively, a display panel which can be lay down may be provided on the upper surface of the document cover 14. In this manner, the display panel can be made upright at a side close to the user when the document cover 14 is unused.

As described above, according to the image copying apparatus of this embodiment, as is the case of the image copying apparatus 1 of the first embodiment, it is possible to locate both the document putting and picking-up places at low positions without increasing the length of the document feeding path, and the image copying apparatus with good efficiency of copying operation is achieved. Further, since the operation panel 90 also can be located at a low position, the apparatus is further convenient for a person in wheelchair and the like to use.

The present embodiment is disclosed only by way of an example, and the present invention is not limited thereto. Rather, various modifications and changes may of course be made in the invention, without departing from the spirit of the invention.

For example, the image copying apparatus 1 of the first embodiment comprises only two movable trays 51, 52. In this structure, the lower movable tray 52 is always exclusively used as a sheet discharging tray. Therefore, the movable tray 52 may comprise a stopper which always projects instead of the retractable stopper 54. In addition, for example in any foregoing embodiment, the operation panel 70 may be provided to two positions, that is, on an upper surface and on a lower position of the main body of apparatus.

In addition, for example in the second embodiment, it is possible to make a display for distinguishing whether the sheet placed on each movable tray 81 at the completion of copying processing is an original or a sheet after being subjected to the copying operation. Alternatively, such a display may be made on the operation panels 70, 90 and the like.

In addition, for example, an image copying apparatus may be constituted in combination of two or more of the structures of the foregoing embodiments. In addition, for example, FIG. 1 shows the image forming section 30 including a single set of each unit. Alternatively, the present invention is also applicable to a color image copying apparatus including plural sets of each unit containing toners of different colors from each other.

Further, in the present invention, it is preferable to provide a fifth tray-controlling section for the time a reading operation finishes, which moves either one of the first and the second trays on which a document discharged from the document discharging port is placed to a position within the bottom region. Accordingly, the user can take out the discharged original within the bottom region.

Further, in the present invention, it is preferable to provide a copied-medium discharging port located within the range wherein the first and the second trays move for discharging a copied-medium on which an image of a document is copied, a third tray-controlling section for the time a copying operation starts, which moves at least either one of the first and the second tray to a copied-medium receiving position where a copied-medium is received from the copied-medium discharging port after a reading operation is finished, and a forth tray-controlling section for the time a copying operation finishes, which moves either one of the first and the second tray on which a copied-medium is placed to a position within the bottom region. Accordingly, the copied-medium is also placed on the movable first tray or second tray. Further, the tray on which the copied-medium is placed is moved into the bottom region. Therefore, the user can take out the copied-medium within the bottom region.

Further, in the present invention, it is preferable to provide a bottom position designating section for designating a tray position within the bottom region basing on an operation by a user, so that the first tray-controlling section moves a corresponding tray to the tray position designated by the bottom position designating section. Accordingly, the user can locate the tray at his/her desiring position. Therefore, each user can place an original document at a position easy for him/her to see.

Further, in case a bottom position designating section is provide, the first and the fifth tray-controlling sections move the corresponding tray to the tray position designated by the bottom position designating section. Accordingly, each user can place an original at a position easy for him to see. Further, each user can take out an original at a position easy for him to see.

Further, in the present invention, it is preferable to provide an operation panel for receiving input of operation command made by a user and of which angle or position is changeable by operation of a user, so that the bottom position designating section designates a tray position basing on the angle or position of the operation panel. Accordingly, a user can arrange the operation panel at an angle or position easy for him/her to see. Further, since the tray position is designated basing on the angle or position of the operation panel, there is no need to independently designate the tray position.

Further, in the present invention, it is preferable to provide a copied-medium discharging port for discharging a copied-medium on which an image of a document is copied, a third tray movable upward and downward within a range covering a copied-medium receiving position where a copied-medium is received from the copied-medium discharging port and the bottom region, and a third tray-controlling section for the time a copying operation starts, which moves the third tray to the copied-medium receiving position. Accordingly, images of an original can be read by use of the first and the second trays. Further, the third tray is simultaneously used to receive the copied-medium. Since the reading operation for the original and the image formation can be simultaneously performed, operation efficiency is further enhanced.

Further, in the present invention, it is preferable to provide a forth tray-controlling section for the time a copying operation finishes, which moves the third tray to a position within the bottom region. Accordingly, a user can take out the copied-medium within the bottom region.

Further, in the present invention, it is preferable to provide a placed substance sensor provided to at least one of the first and the second trays for detecting a placed substance, and a tray position storing section for storing the tray position of the corresponding tray when the placed substance sensor newly detects a placed substance while the tray is within the bottom region, so that the fifth tray-controlling section moves the corresponding tray to the tray position stored in the tray position storing section. Accordingly, the tray position at the time when a user has placed an original on the tray is stored. Then, the tray on which the discharged original is placed is moved to that tray position. Therefore, the user can take out the original at a position easy for him/her to see.

Further, in the present invention, it is preferable to provide a retracting member, and stoppers of respective trays preventing a substance placed thereon from slipping toward the side of document drawing-in and the document discharging ports, and retracted by the retracting member when the tray is located at the document feeding position, so that the trays are inclined in such a manner that their sides of the document drawing-in and the document discharging ports are located lower than their opposite sides. Accordingly, the originals, etc. placed on the first tray or the second tray moves toward the document drawing-in port side or document discharging port side by its own weight. At this time, since the stopper prevents the original from slipping, there is no fear that the original slips from the tray during the movement of the tray. On the other hand, at the document feeding position, the stopper is retracted by the retracting member. Therefore, the original is fed to the document drawing-in port by its own weight.

According to the image copying apparatus of the present invention, it is possible to locate both the document putting and taking-out places at low positions without increasing the length of the document feeding path, and the image copying apparatus with good efficiency of copying operation is achieved.

What is claimed is:

1. An image copying apparatus comprising:

a document drawing-in port for drawing in a document before a reading operation;

a document discharging port located above or below the document drawing-in port for discharging the document after the reading operation;

a document feeding path extending from the document drawing-in port to the document discharging port;

an image reading section provided in a midway section of the document feeding path;

first and second trays movable upward and downward within a range covering a document feeding position where the document is fed to the document drawing-in port, a document receiving position where the document is received from the document discharging port, and a bottom region located further lower than the lower of these positions;

a first tray-controlling section for the time a document is to be placed on one of the first or second trays, which moves at least one of the first and the second trays to a position within the bottom region; and a second tray-controlling section for the time the reading operation starts, which moves either one of the first and the second tray on which the document is placed to the document feeding position and moves the other tray to the document receiving position.

2. An image copying apparatus according to claim 1, further comprising:

a copied-medium discharging port located within the range wherein the first and the second trays move for discharging a copied-medium on which an image of the document is copied;

a third tray-controlling section for the time a copying operation starts, which moves at least either one of the first and the second tray to a copied-medium receiving position where the copied-medium is received from the copied-medium discharging port after the reading operation is finished; and a forth tray-controlling section for the time the copying operation finishes, which moves either one of the first and the second tray on which a copied-medium is placed to a position within the bottom region.

3. An image copying apparatus according to claim 1, further comprising a retracting member, wherein the first and the second trays are inclined in such a manner that their sides of the document drawing-in and the document discharging ports are located lower than their opposite sides, and include respectively a stopper preventing a substance placed thereon from slipping toward the side of document drawing-in and the document discharging ports, and retracted by the retracting member when the tray is located at the document feeding position.

4. An image copying apparatus according to claim 1, further comprising a bottom position designating section for designating a tray position within the bottom region biased on an operation by a user, wherein the first tray-controlling section moves a corresponding tray to the tray position designated by the bottom position designating section.

5. An image copying apparatus according to claim 4, further comprising an operation panel for receiving input of an operation command made by the user and of which an angle or position is changeable by operation by the user, wherein the bottom position designating section designates a tray position biased on the angle or position of the operation panel.

6. An image copying apparatus according to claim 1, further comprising:

a copied-medium discharging port for discharging a copied-medium on which an image of the document is copied;

a third tray movable upward and downward within a range covering a copied-medium receiving position where the copied-medium is received from the copied-medium discharging port and the bottom region; and a third tray-controlling section for the time a copying operation starts, which moves the third tray to the copied-medium receiving position.

7. An image copying apparatus according to claim 6, further comprising a forth tray-controlling section for the time a copying operation finishes, which moves the third tray to the position within the bottom region.

8. An image copying apparatus according to claim 1, further comprising a fifth tray-controlling section for the time the reading operation finishes, which moves either one of the first and the second trays on which a document discharged from the document discharging port is placed to a position within the bottom region.

9. An image copying apparatus according to claim 8, further comprising:

a placed substance sensor provided to at least one of the first and the second trays for detecting a placed substance; and a tray position storing section for storing the tray position of the corresponding tray when the placed substance sensor newly detects the placed substance while the tray is within the bottom region, wherein the fifth tray-controlling section moves the corresponding tray to the tray position stored in the tray position storing section.

10. An image copying apparatus according to claim 8, further comprising a bottom position designating section for designating a tray position within the bottom region biased on an operation by a user, wherein the first and the fifth tray-controlling sections move the corresponding tray to the tray position designated by the bottom position designating section.

11. An image copying apparatus according to claim 10, further comprising an operation panel for receiving input of operation command made by the user and of which angle or position is changeable by operation of the user, wherein the bottom position designating section designates a tray position biased on the angle or position of the operation panel.

12. An image copying apparatus comprising:

a document drawing-in port for drawing in a document before a reading operation;

a document discharging port located above or below the document drawing-in port for discharging the document after the reading operation;

a document feeding path extending from the document drawing-in port to the document discharging port;

an image reading section provided in a midway section of the document feeding path;

a copied-medium discharging port for discharging a copied-medium on which an image of the document is copied;

a plurality of trays movable upward and downward within a range covering a document feeding position where the document is fed to the document drawing-in port, a document receiving position where the document is received from the document discharging port, a copied-medium receiving position where the copied-medium is to be received from the copied-medium discharging port, and a bottom region located further lower than the lowest one of these positions;

placed substance sensors provided to each of the plurality of trays for detecting a placed substance;

a first tray-controlling section for the time the document is to be placed on one of the first or second trays, which moves at least one of the trays to the position within the bottom region basing on an operation by the user in case there is no tray within the bottom region;

a read-document receiving tray setting section for setting one of the trays other than the tray on which a document is placed as a read-document receiving tray basing on the result of detection by the placed substance sensors;

a copied-medium receiving tray setting section for setting one of the trays other than the read-document receiving tray as a copied-medium receiving tray;

a second tray-controlling section for the time a reading operation starts, which moves the tray on which the document is placed to the document feeding position and moves the read-document receiving tray to a document receiving position;

a third tray-controlling section for the time a copying operation starts, which moves the copied-medium receiving tray to a copied-medium receiving position before the copying operation is started; and a forth tray-controlling section for the time the copying operation finishes, which moves the read-document receiving tray and the copied-medium receiving tray to positions within the bottom region.

* * * * *

UNITED STATES PATENT AND TRADEMARK OFFICE

CERTIFICATE OF CORRECTION

PATENT NO. : 7,231,171 B2
APPLICATION NO. : 11/028677
DATED : June 12, 2007
INVENTOR(S) : Yoshifumi Shibata et al.

It is certified that error appears in the above-identified patent and that said Letters Patent is hereby corrected as shown below:

In Claim 2, column 15, line 13: please replace the word “forth” with the word --fourth--

In Claim 7, column 15, line 56: please replace the word “forth” with the word --fourth--

In Claim 12, column 18, line 1: please replace the word “forth” with the word --fourth--

Signed and Sealed this

Thirteenth Day of November, 2007

JON W. DUDAS
*Director of the United States Patent and Trademark Office*